US008151803B2

(12) United States Patent
Inagaki

(10) Patent No.: US 8,151,803 B2
(45) Date of Patent: Apr. 10, 2012

(54) SMOKING APPLIANCE

(75) Inventor: Michihiro Inagaki, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/512,589

(22) Filed: Jul. 30, 2009

(65) Prior Publication Data

US 2009/0288668 A1 Nov. 26, 2009

Related U.S. Application Data

(63) Continuation of application No. PCT/JP2008/051419, filed on Jan. 30, 2008.

(30) Foreign Application Priority Data

Feb. 2, 2007 (JP) ..... 2007-023903

(51) Int. Cl.
*A24F 13/02* (2006.01)

(52) U.S. Cl. ..... 131/187; 131/200; 131/331; 131/185

(58) Field of Classification Search ..... 131/200, 131/331, 187, 175
See application file for complete search history.

(56) References Cited

U.S. PATENT DOCUMENTS

| | | | | |
|---|---|---|---|---|
| 2,974,669 | A * | 3/1961 | Ellis | 131/330 |
| 3,916,916 | A * | 11/1975 | Bramucci | 131/175 |
| 4,182,348 | A * | 1/1980 | Seehofer et al. | 131/334 |
| 4,947,874 | A | 8/1990 | Brooks et al. | |
| 5,392,793 | A * | 2/1995 | Molloy | 131/339 |
| 2005/0145260 | A1 * | 7/2005 | Inagaki et al. | 131/331 |

FOREIGN PATENT DOCUMENTS

| | | | |
|---|---|---|---|
| CA | 2079495 | A1 | 4/1993 |
| CA | 2279621 | A1 | 2/2000 |
| JP | 58-7275 | B2 | 2/1983 |
| WO | WO-2004/021810 | A1 | 3/2004 |

OTHER PUBLICATIONS

Baker, Richard R., "The Release of Nicotine and Semivolatile Components Inside a Burning Cigarette", 1999, British American Tobacco Documents Archive, Regents of the University of California, http://bat.library.ucsf.edu/tid/rao17a99.*

Baker, "The Release of Nicotine and Semi-Volatile Components Inside a Burning Cigarette", Group Research & Development Centre, British-American Tobacco Co. Ltd., Southampton, 92 pages, Jun. 15, 1983.

* cited by examiner

*Primary Examiner* — Richard Crispino
*Assistant Examiner* — Dionne Walls Mayes
(74) *Attorney, Agent, or Firm* — Birch, Stewart, Kolasch & Birch, LLP

(57) ABSTRACT

An object of the present invention is to provide a smoking appliance which can heat a filter medium for eliminating particulate phase components in tobacco smoke to a desired temperature precisely as well as can ensure safety for the smoker. According to the present invention, there is provided a smoking appliance including a holder having a through hole serving as a smoke passage, which detachably holds a filter medium in a middle of the smoke passage, a heater attached to the holder at a location upstream to the filter medium, a heat insulator attached to the holder at a location upstream to the heater, and a metal plate which covers surfaces of the heater facing the filter medium and the smoke passage.

7 Claims, 3 Drawing Sheets

SMOKING APPLIANCE

CROSS-REFERENCE TO RELATED APPLICATIONS

This is a Continuation Application of PCT Application No. PCT/JP2008/051419, filed Jan. 30, 2008, which was published under PCT Article 21(2) in Japanese.

This application is based upon and claims the benefit of priority from prior Japanese Patent Application No. 2007-023903, filed Feb. 2, 2007, the entire contents of which are incorporated herein by reference.

BACKGROUND OF THE INVENTION

1. Field of the Invention

The present invention relates to a smoking appliance which heats a filter medium for smoking.

2. Description of the Related Art

Conventionally, there have been known a number of smoking appliances having a heating means, but most of them are of a type which generates tobacco-like aerosol by locally heating the cigarette.

On the other hand, as a smoking filter having a filter medium, a type which comprises a means for heating a filter medium or surroundings of the filter medium (WO 2004/021810). In this smoking filter, the filter medium is heated with a heating means to evaporate some of particulate phase components which are trapped by the filter medium at room temperature. Thus, harmful components are eliminated and also adverse effect on the flavor and taste of tobacco is suppressed.

It is required in such a smoking filter that the filter medium should be heated to a desired temperature precisely as well as safety for the smoker should be ensured. Here, since the smoking appliance of the aerosol-generating type is controlled at higher temperatures, it is very difficult to divert the heating means thereof to that for a filter-heating type smoking appliance.

BRIEF SUMMARY OF THE INVENTION

An object of the present invention is to provide a smoking appliance which can heat a filter medium for eliminating particulate phase components in tobacco smoke to a desired temperature precisely as well as can ensure safety for the smoker.

A smoking appliance according to an aspect of the present invention is characterized by comprising: a holder having a through hole serving as a smoke passage, which detachably holds a filter medium in a middle of the smoke passage; a heater attached to the holder at a location upstream to the filter medium; a heat insulator attached to the holder at a location upstream to the heater; and a metal plate which covers surfaces of the heater facing the filter medium and the smoke passage.

In the smoking appliance of the present invention, it is preferable that the heating temperature of the heater should be 100 to 200° C. The smoking appliance of the present invention may include a sensor which monitors a heating temperature by the heater. The smoking appliance of the present invention may comprise a battery which supplies power to the heater. It is preferable that the metal plate should be attached to the holder via an O-ring so as to cover surfaces of the heater facing the filter medium and the smoke passage. It is desirable that the holder should be formed of any engineering plastics. The smoking appliance of the present invention may comprise a catalyst filling layer to be detachably inserted to the smoke passage of the holder at a location upstream to the filter medium.

According to the present invention, it is possible to provide a smoking appliance which can heat the filter medium for eliminating particulate phase components in tobacco smoke to a desired temperature precisely as well as can ensure safety for the smoker.

DETAILED DESCRIPTION OF THE INVENTION

The present invention will now be described in detail with reference to accompanying drawings.

Figure 1:
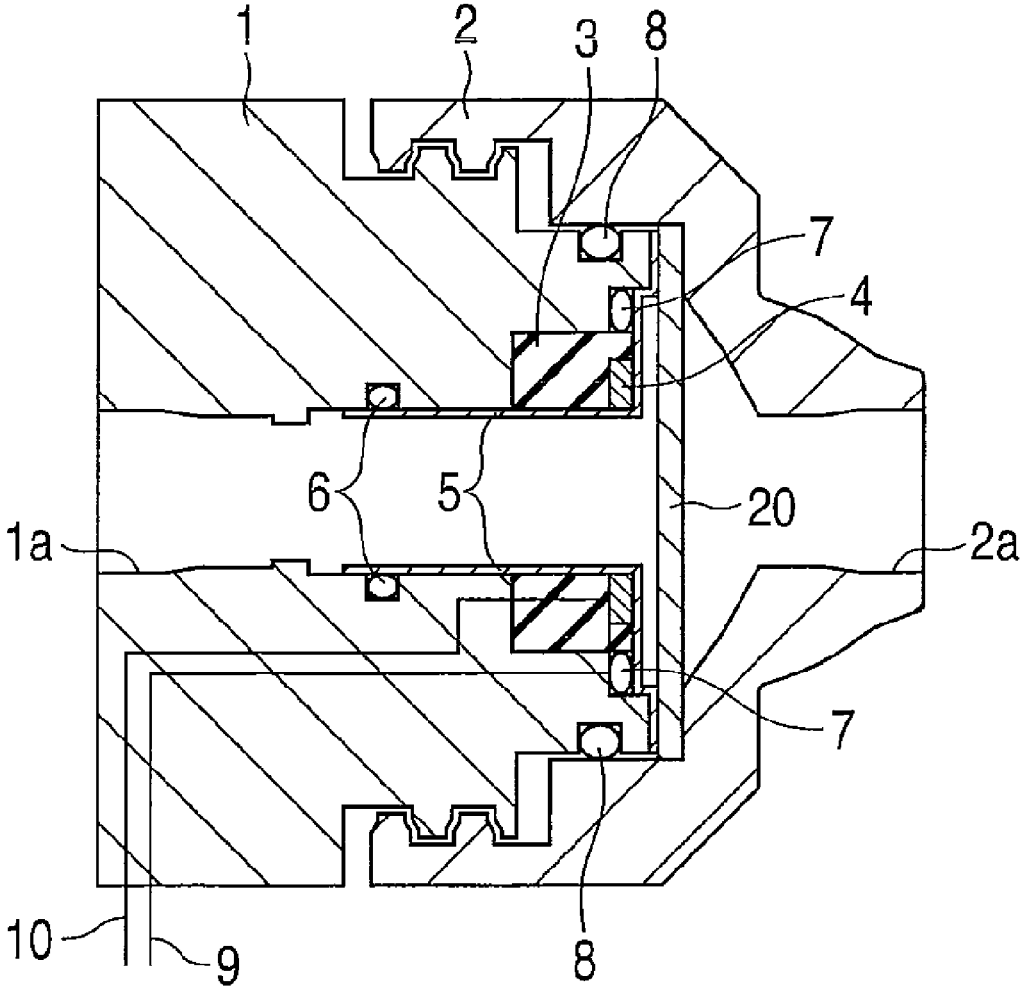
FIG. 1 is a cross-sectional view of a smoking appliance according to an embodiment of the present invention.

FIG. 1 is a cross-sectional view of a smoking appliance according to an embodiment of the present invention. This smoking appliance includes a male holder 1 having an external thread and a female holder 2 having an internal thread, and these holders are screwed. A smoke passage is made through the holder 1 and holder 2. It is preferable that the holders 1 and 2 should be formed of an engineering plastics such as polyetheretherketone (PEEK) and polytetrafluoroethylene (PTEE). These engineering plastics have high heat-resistance, excellent processability and excellent sanitary property. As will be described later, a cigarette is inserted to a smoke passage opening 1*a* on the upstream side (the left-hand side in the figure) of the holder 1, and a mouthpiece is inserted to a smoke passage opening 2*a* on the downstream side (the right-hand side in the figure) of the holder 2. The smoke passage opening 1*a* and smoke passage opening 2*a* have a tapered structure so that a cigarette or mouthpiece can be easily attached without leakage. Further, a filter medium 20 is detachably held in a middle of the smoke passage between the holder 1 and holder 2. An example of the filter medium 20 is a high efficiency particulate air (HEPA) filter. Since the holder 1 and holder 2 are screwed as described above, replacement of the filter medium 20 and cleaning of the inside of the smoking appliance can be easily performed.

A heat insulator 3 and a heater 4 are attached to the rear portion of the holder 1. The heater 4 is located on the upstream side to the filter medium 20 so as to face the filter medium 20, where a part of the heater 4 faces the smoke passage. The heat insulator 3 is located on the upstream side to the heater 4 in the surface facing the smoke passage and located at the outer periphery of the heater 4 in the surface facing the filter medium so as to surround the heater 4. It should be noted that a heat insulator may be provided for the holder 2 as well. Usable examples of the heat insulator 3 include materials having extremely low heat conductivity, such as a structure made of ceramic powder reinforced with inorganic fibers and having non-closed cells having a size of 0.1 μm or less and calcium silicate. A heater cover 5 made of a metal plate is provided via O-rings 6 and 7 on the surface facing the smoke passage and the surface facing the filter medium in the rear portion of the holder 1 so as to cover the heat insulator 3 and the heater 4. The holder 1 and the holder 2 as well are screwed via an O-ring 8. It is preferable that the O-rings used here should be made of a heat-resisting resin such as fluorocarbon resin.

A power-supplying wire 9 for the heater is arranged inside the holder 1. Further, a temperature sensor (for example, a thermocouple or thermistor) which monitors the temperature of the heater is connected to the heater 4, and also a wire 10 for the temperature sensor is arranged inside the holder 1.

Figure 2:
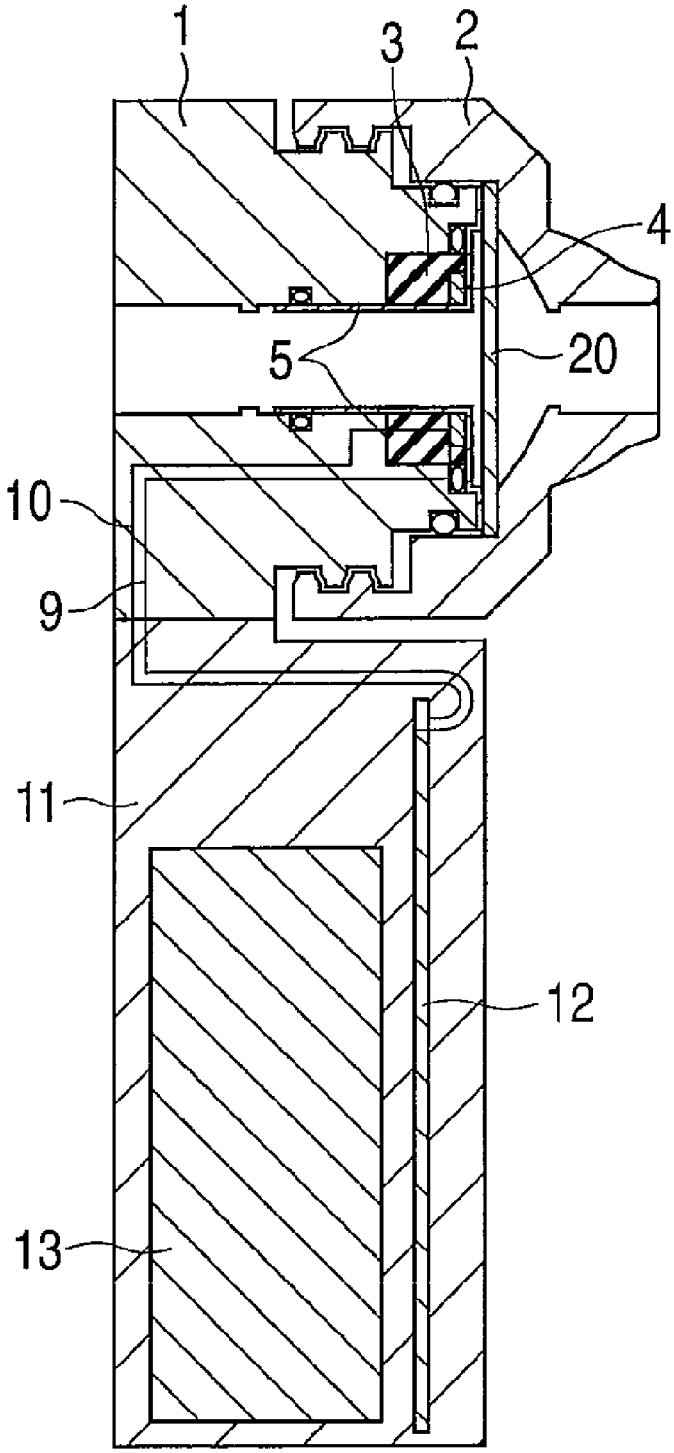
FIG. 2 is a cross-sectional view of the smoking appliance shown in FIG. 1 to which a battery box is attached.

FIG. 2 is a cross-sectional view of the smoking appliance shown in FIG. 1 to which a battery box is connected. As shown in FIG. 2, a battery box 11 is attached to a lower portion of the smoking appliance shown in FIG. 1. A circuit board 12 and a battery 13 are provided in the battery box 11. The power-supplying wire 9 for the heater and the wire 10 for the temperature sensor are connected to the circuit board 12, and further the circuit board 12 is connected to the battery 13.

Figure 3:
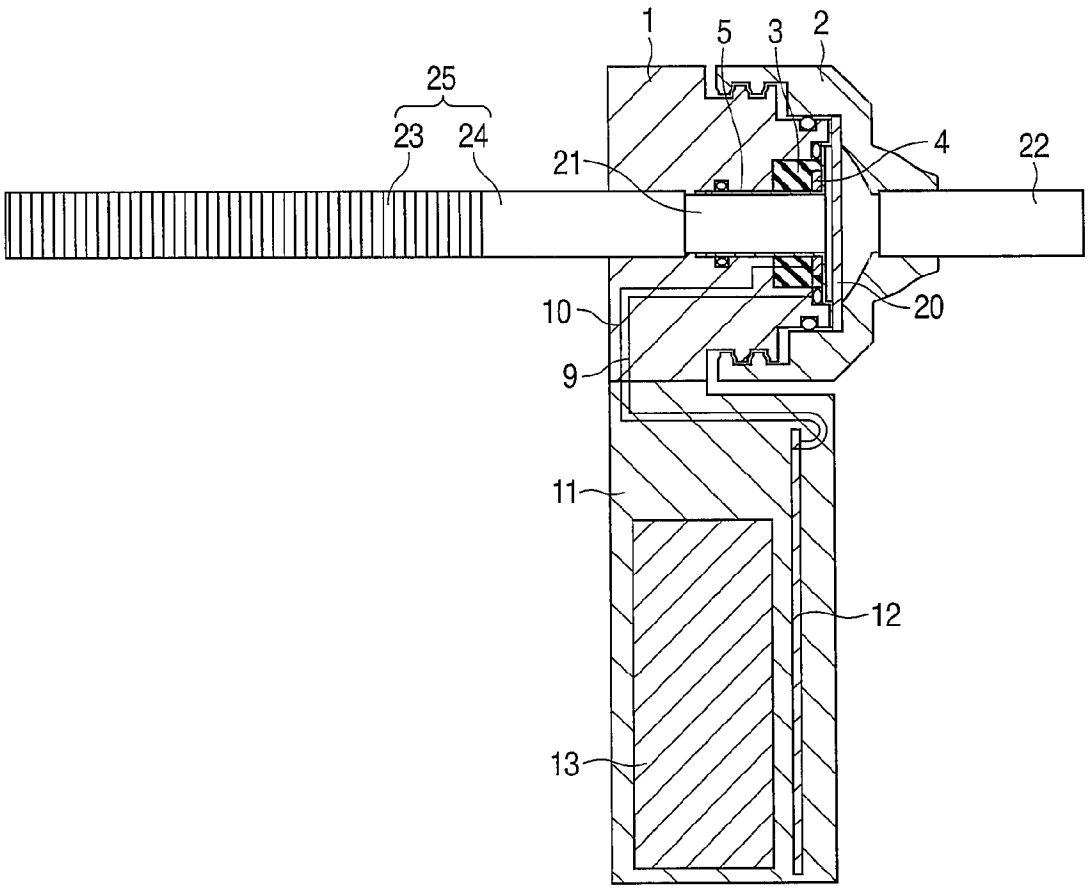
FIG. 3 is a cross-sectional view showing a state of smoking a cigarette using the smoking appliance according the embodiment.

FIG. 3 is a cross-sectional view showing a state of smoking a cigarette using the smoking appliance with the battery box shown in FIG. 2. As described with reference to FIG. 1, the filter medium 20 is detachably held between the holder 1 and holder 2. A catalyst filling layer 21 is inserted to the smoke passage of the holder 1. The catalyst filling layer 21 is filled with an oxide catalyst which can selectively eliminate carbon monoxide in tobacco smoke, such as $MnO_2$—CuO, CuO/ZnO, CuO/$ZnO_2$, and $ZrO_2$/$CeO_2$. A mouthpiece 22 is attached on the smoke passage opening 2*a* of the holder 2. In this state, a cigarette 25 is inserted to the smoke passage opening 1*a* of the holder 1, the cigarette 25 being prepared by connecting a tobacco rod 23 with a cigarette filter 24 in which adsorbent is dispersed.

The heater 4 is supplied with power from the battery 13 via a control circuit and safety circuit provided on the circuit board 12 and heated to 100 to 200° C. The temperature of the heater 4 is monitored with the temperature sensor and controlled to the desired temperature with the control circuit on the circuit board 12. The control circuit employs such a method as PID control.

It should be noted that a differential pressure sensor may be provided to sense smoke so that the heater 4 is supplied with power from the battery 13 only in smoking to make the heater 4 reach the desired temperature. In this case, the power supply from the battery 13 may be stopped while not smoking to lower the temperature of the heater 4 relative to the desired temperature, so that the power consumption can be reduced.

Here, the heat from the heater 4 is propagated to the filter medium 20 via the heater cover 5 made of a metal plate, and thus the filter medium 20 can be uniformly heated. Since the heater 4 is surrounded by the heat insulator 3, the heat from the heater 4 is prevented from being propagated to the holder, which makes it possible to maintain the surface temperature of the holder at a low level and to protect a burn on the smoker or the like. In addition, the heat insulator 3 can reduce the power consumption of the battery 13 as well.

Further, since the surfaces of the heater 4 facing the filter medium and the smoke passage are covered with the heater cover 5 made of a metal plate while being sealed with the O-rings 6 and 7, it is possible to prevent tobacco smoke from depositing on the heater 4 and further to prevent pieces of the heat insulator 3 from scattering into tobacco smoke.

As described above, the smoking appliance of the present invention can heat the filter medium for eliminating particulate phase components in tobacco smoke to a desired temperature precisely as well as can ensure safety for the smoker.

What is claimed is:

1. A smoking appliance comprising:

a holder having an opening on upstream and downstream ends thereof and a through hole serving as a smoke passage between the openings, the opening on the upstream end being capable of receiving an end of a cigarette;

a filter medium detachably held in a central portion of the smoke passage of the holder;

a heater attached to the holder at a location upstream of the filter medium so as to be arranged around the smoke passage, a part of the heater facing the smoke passage;

a heat insulator attached to the holder at a location upstream of the heater on a surface facing the smoke passage and at an outer periphery of the heater on a surface facing the filter medium so as to surround the heater; and a metal plate which covers surfaces of the heater facing the filter medium and the smoke passage.

2. The smoking appliance according to claim 1, wherein a heating temperature of the heater is 100 to 200° C.

3. The smoking appliance according to claim 1, comprising a temperature sensor which monitors the temperature of the heater.

4. The smoking appliance according to claim 1, comprising a battery which supplies power to the heater.

5. The smoking appliance according to claim 1, wherein the metal plate is attached to the holder via an O-ring so as to cover surfaces of the heater facing the filter medium and the smoke passage.

6. The smoking appliance according to claim 1, wherein the holder is formed of an engineering plastics.

7. The smoking appliance according to claim 1, comprising a catalyst filling layer which is detachably inserted into the smoking passage of the holder at a location upstream of the filter medium.

* * * * *